US006478297B1

(12) United States Patent
Messerschmid

(10) Patent No.: US 6,478,297 B1
(45) Date of Patent: Nov. 12, 2002

(54) ARRANGEMENT FOR TRANSPORTING FLAT BLANKS

(75) Inventor: Uwe Messerschmid, Albershausen (DE)

(73) Assignee: Michael Hoerauf Maschinenfabrik GmbH & Co. KG, Donzdorf (DE)

( * ) Notice: Subject to any disclaimer, the term of this patent is extended or adjusted under 35 U.S.C. 154(b) by 0 days.

(21) Appl. No.: 09/548,657

(22) Filed: Apr. 13, 2000

(30) Foreign Application Priority Data

Apr. 14, 1999 (DE) ..... 199 16 668

(51) Int. Cl.[7] ..... B65H 29/04

(52) U.S. Cl. ..... 271/277; 271/204; 271/206; 198/803.1; 198/803.7

(58) Field of Search ..... 271/277, 204–6; 198/80.31, 80.37

(56) References Cited

U.S. PATENT DOCUMENTS 4,799,664 A * 1/1989 Burger ..... 271/277
5,007,629 A * 4/1991 Eberle et al. ..... 271/277
5,564,337 A * 10/1996 Uehara et al. ..... 271/204
5,782,337 A * 7/1998 Langland ..... 198/803.1
6,129,350 A * 10/2000 St. Ours ..... 271/204

OTHER PUBLICATIONS

Hörauf Brochure—BDM 30.

* cited by examiner

*Primary Examiner*—Christopher P. Ellis
*Assistant Examiner*—Mark A. Deuble
(74) *Attorney, Agent, or Firm*—Crowell & Moring LLP

(57) ABSTRACT

An arrangement is described for transporting cardboard blanks or the like in the flat, in particular for book cover or letter file machines. The arrangement includes at least two sequenced transport belts extending parallel to one another, which are guided over deflecting wheels. Grippers are applied to the transport belts to hold the blanks. The grippers comprise controlled, swivelling clamping elements, which can be opened at the deflecting wheels.

25 Claims, 3 Drawing Sheets

ARRANGEMENT FOR TRANSPORTING FLAT BLANKS

BACKGROUND AND SUMMARY OF THE INVENTION

This application claims priority of German application number 199 16 68.4, filed Apr. 14, 1999, the disclosure of which is expressly incorporated by reference herein.

The present invention relates to an arrangement for transporting cardboard blanks or the like in the flat, in particular for book cover or letter file machines, comprising at least two sequenced transport belts extending parallel to one another which are guided over deflecting wheels, at which transport belts grippers for holding the blanks are applied.

An arrangement of this type is prior art in the Hoerauf brochure BDM 30. The embodiment of the grippers is not described in any detail in this brochure, but the relevant machine in practice is so designed that the blanks were clamped between clamping parts, which engaged with two opposite edges of the blank.

It is an object of the present invention to improve an arrangement of the above mentioned type with regard to the grippers.

This object has been achieved in accordance with the present invention in that the grippers comprise controlled, swivelling clamping elements, which can be opened at the deflecting wheels.

Grippers of this design are capable of holding a blank reliably and with exact positioning. Furthermore, they can grip a blank at a deflecting wheel and let go in time at the other deflecting wheel. This does not involve a complicated process.

Advantageously the grippers are clamped by fixing elements in the teeth gaps of the transport belts, which are toothed belts. By using this type of fixing elements, the grippers can not only be applied easily to the transport belts, they are also adjustable or exchangeable as required.

For the purpose of the invention, the grippers comprise a supporting body on which the respective clamping element is supported with a swivel axle. In this way the grippers are divided into a holding element and a function element.

In an embodiment of the present invention, the clamping elements take the form of essentially L-shaped fingers, whose free limbs can be advanced to the blank in their axial direction. This embodiment requires the smallest possible clamping surface on the blank. With clamping elements of this design, the procedural steps to be carried out by the machine, for example the folding in of an edge by rotating brushes in book cover machines, are not hindered.

Advantageously, the clamping elements are arranged at the front edge in transport direction of the blanks. Thus the blanks are merely drawn along and therefore reliably transported. The other edges of the blank are free so that procedural steps can be carried out there unhindered.

It is provided in preferred embodiments that, at a distance corresponding to the space between two grippers in the transport direction of the transport belts, the deflecting wheels, in the form of toothed belt wheels, each have a milled tooth. Thus, for example, one single tooth gap arises in the circumference of the deflecting wheel, in which gap the affixing structure can engage when the gap passes during rotation. Thus the affixing structure are not hindered by the design type of the deflecting wheel.

In certain preferred embodiments of the present invention, cam discs are provided for controlling the clamping elements, which cam discs are arranged coaxial to the deflecting wheels, on which cam discs spring-loaded rollers are disposed which swivel with the clamping elements. The clamping elements in the area of the deflecting wheels can therefore be easily controlled, namely there where it is necessary that the grippers be opened. Separate drives for the controlling structure can thus be omitted.

To bridge the opening phase of the clamping elements, clamping rollers which guide the blanks can be provided in the area of the deflecting wheels. Thus the respective blank is at no time left unattended and unclamped, not even at the deflecting wheels.

For the purpose of certain preferred embodiments of the present invention it is provided that the rollers, which are disposed on the cam discs, are supported outside of the area of the cam discs on rails extending parallel to the transport belts. This prevents the blanks becoming deformed during transport due to excessively long traveling paths of the clamping elements.

These and further objects, features and advantages of the present invention will become more readily apparent from the following detailed description thereof when taken in conjunction with the accompanying drawings.

DETAILED DESCRIPTION OF THE DRAWINGS

Figure 1:
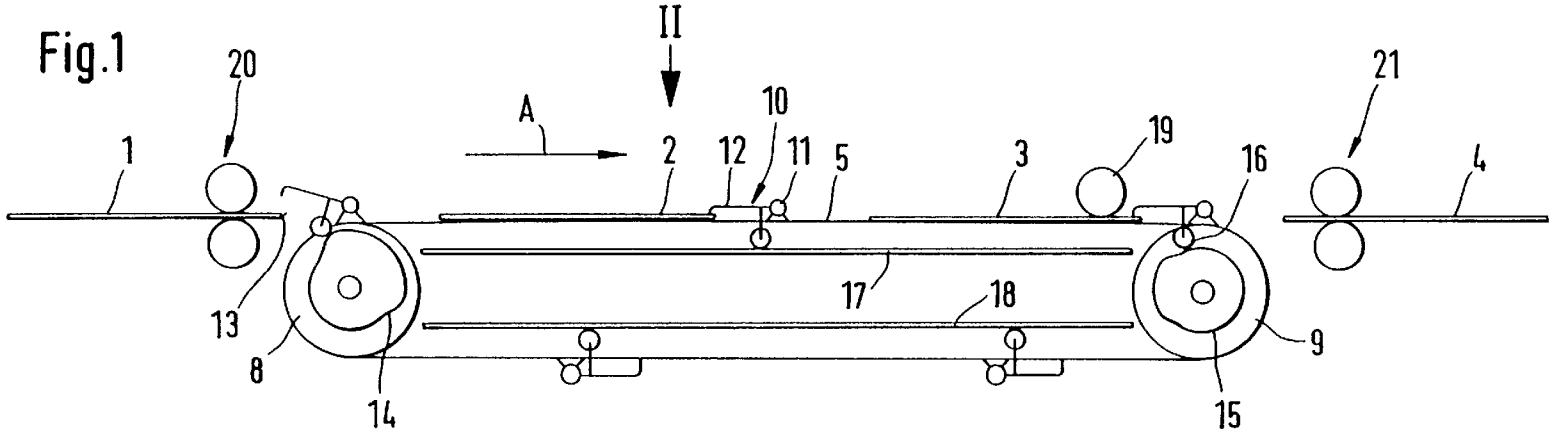
FIG. 1 is a schematic side view of an arrangement constructed according to a preferred embodiment of the present invention.
Figure 2:
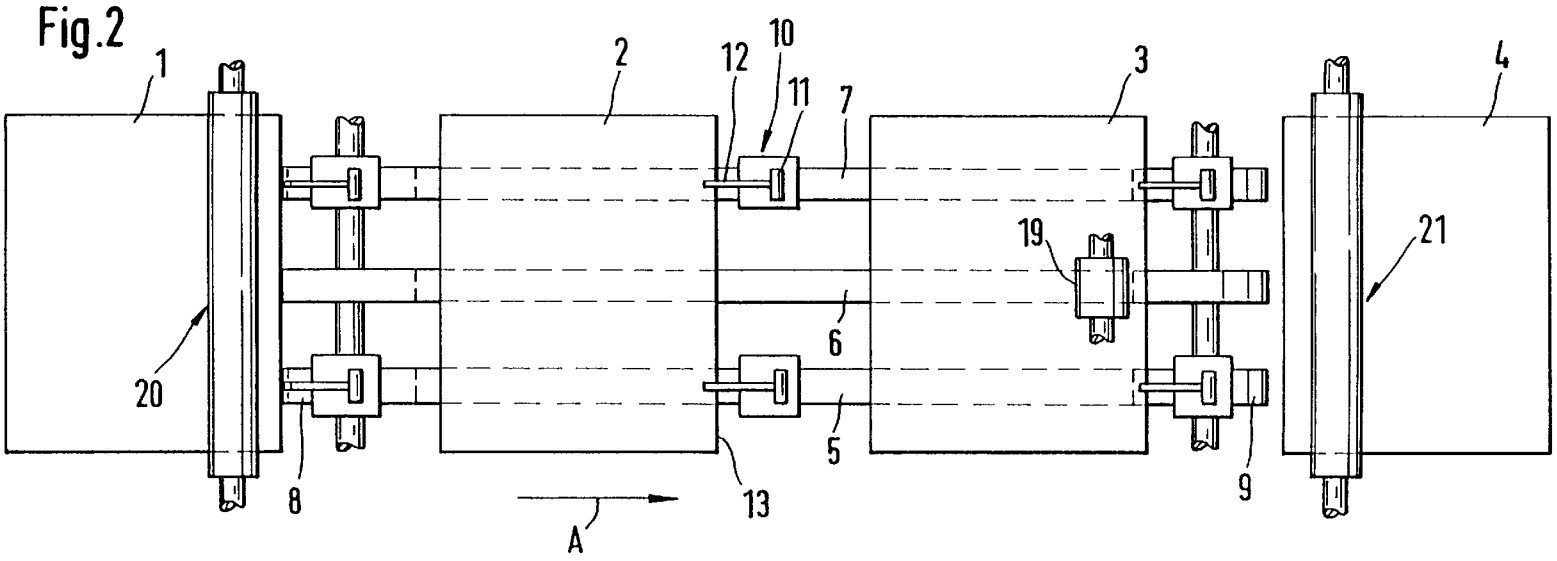
FIG. 2 is a view in the direction of the arrow II of FIG. 1.

The arrangement for transporting blanks 1, 2, 3 and 4 shown only very schematically and greatly reduced in FIGS. 1 and 2 is preferably applicable to a book cover or letter file machine, though not, however, limited to these machines. The blanks 1 to 4 in the flat, and made of, for example, cardboard, are prefabricated materials which may be covered in plastic. Only blanks 2 and 3 are shown on the arrangement, while blank 1 is directly upstream of the arrangement and blank 4 has just left the arrangement. The transport direction is denoted by A.

The arrangement comprises in the present case three transport belts 5,6 and 7 arranged parallel to one another, which are guided at their ends over deflecting wheels 8 and 9, one of the deflecting wheels being driven.

On the outer transport belts 5 and 7, grippers 10 are affixed, while the middle transport belt 6 has preferably no gripper. These grippers 10 are only denoted in FIGS. 1 and 2 and are described below with the aid of FIGS. 3 to 5 in more detail. The grippers can be opened in the area of the deflecting wheels 8 and 9, but the grippers are closed during the transport of blanks 2 and 3. The grippers 10 are also closed during the non-transporting return of the transporting means. In order to hold the blanks 2 and 3, the grippers 10 each comprise a clamping element 12, which can be swivelled around a swivel axle 11. The clamping elements 12 are formed as L-shaped fingers, which can be opened at the deflecting wheels 8, 9 to hold or release the blanks 1 or 4. The clamping elements 12 with their free limb can be advanced to the respective blanks 2 and 3. The blanks 2 and 3 are held only at their front edges 13 by the grippers 10.

Cam discs 14 and 15 are stationarily arranged coaxially to the deflecting wheels 8 and 9, which cam discs serve to control the clamping elements 12. The individual grippers 10 have for this purpose two rollers 16 each, which can be swivelled together with the clamping elements 12 and which move, spring-loaded, on rolling contact with the cam discs 8 and 9. By means thereof, the grippers 10 can be opened and closed in the area of the deflecting wheels 8 and 9. In the area between the deflecting wheels 8 and 9, that is, outside of the cam discs 14 and 15, the rollers 16 are guided in rails 17 and 18.

Figure 3:
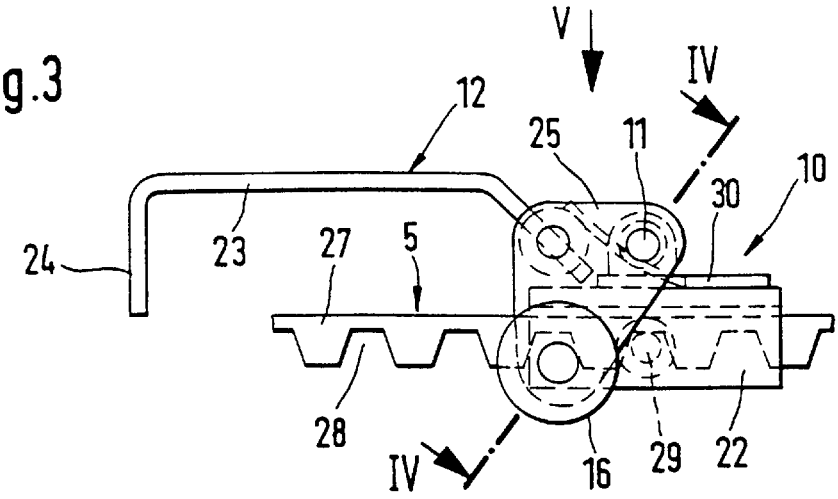
FIG. 3 is an enlarged representation of a gripper according to the present invention in a view according to the arrow direction III of FIG. 5.
Figure 4:
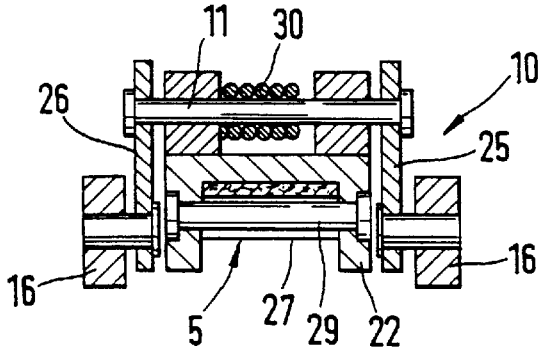
FIG. 4 is a sectional view through the gripper along the section plane IV—IV of FIG. 3.
Figure 5:
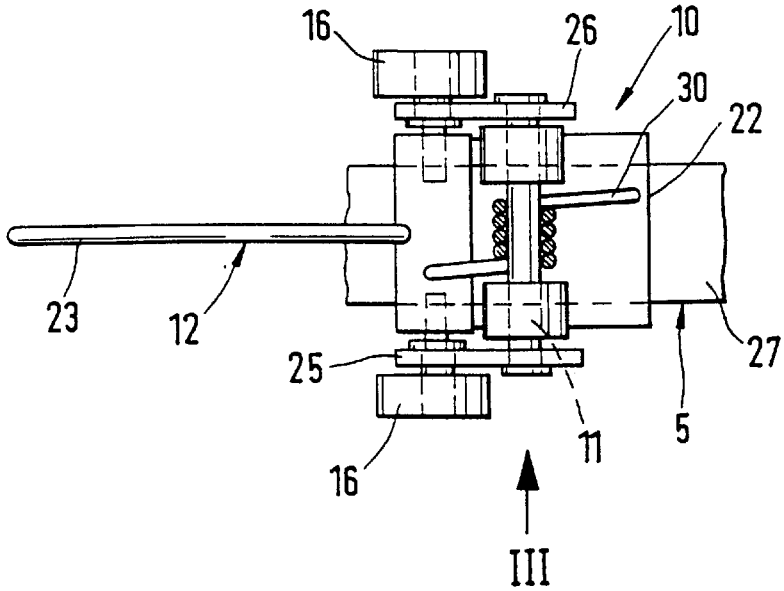
FIG. 5 is a view of the gripper in the direction of the arrow V of FIG. 3.

Directly before leaving the transport belts 5, 6 and 7, the blank 3 located there is pressed by a clamping roller 19, which is disposed only on the gripper-free center transport belt 6 and which roller 19 is freely rotatable. Directly upstream of the first deflecting wheel 8 and directly downstream of the last deflecting wheel 9, two clamping roller pairs 20 and 21 are located, which each form a transport device which transport the blanks 1 and 4 reliably, before they are seized by the gripperslo or they are released by the last gripper 10. These clamping rollers 19, 20 and 21 thus bridge the opening phase of the clamping elements 12 in the area of the deflecting wheels 8 and 9 and guide the blanks 1, 3 and 4. FIGS. 3, 4 and 5 which are described below show a gripper 10 in detail and in enlarged dimensions. The swivel axle 11 already described above and the swivelling clamping element 12 supported there can be seen.

The grippers 10 comprise a supporting body 22 which can be affixed to the transport belt 5, on which supporting body 22 a clamping element 12 in the form of an essentially L-shaped finger 23 is applied. The free limb 24 of the finger 23 can be advanced in its axial direction to the blank (here not shown).

A swivelling holding part comprising two supporting surfaces 25 and 26 is arranged on the supporting body 22. The supporting surfaces 25 and 26 also take up the rollers 16 which swivel with the finger 23.

As can be seen, the transport belt 5 is preferably in the form of a toothed belt 27, in whose teeth gaps 28 the affixing elements 29 for placing the supporting body 22 are arranged. The affixing elements 29 comprise, for example, a pin, which is calked at its ends. The grippers 10 can, by means thereof, be clamped to the transport belt 5.

The individual grippers 10 each comprise a leg spring 30, which loads the rollers 16 and which presses them onto the cam discs 14 and 15.

Figure 6:
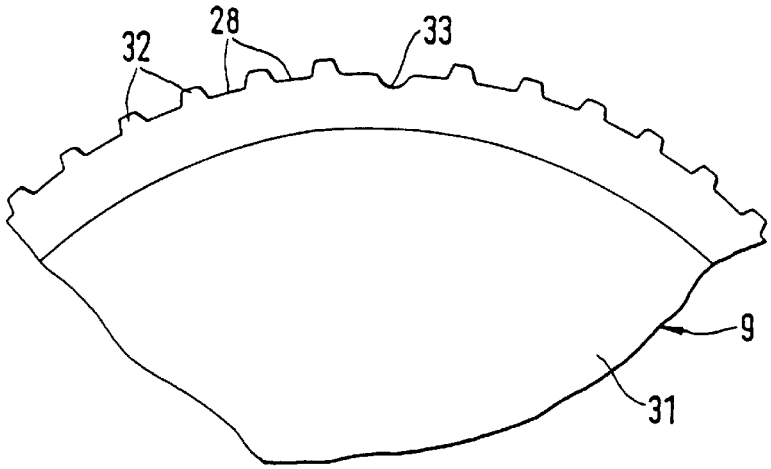
FIG. 6 shows an enlarged section of a deflecting wheel in the form of a toothed belt wheel for preferred embodiments of the present invention.

A section of the front deflecting wheel 9 in transport direction A is shown in FIG. 6 in enlarged dimensions. As can be seen, this takes the form of a toothed belt wheel 31, which comprises on its periphery teeth 32 with gaps 28 located therebetween. On at least one point on the periphery, a milled tooth 33 is provided, which creates a space for the pin of the affixing elements 29. The periphery of the toothed belt wheel 31 corresponds in this case to the distance between two grippers 10.

Figure 7:
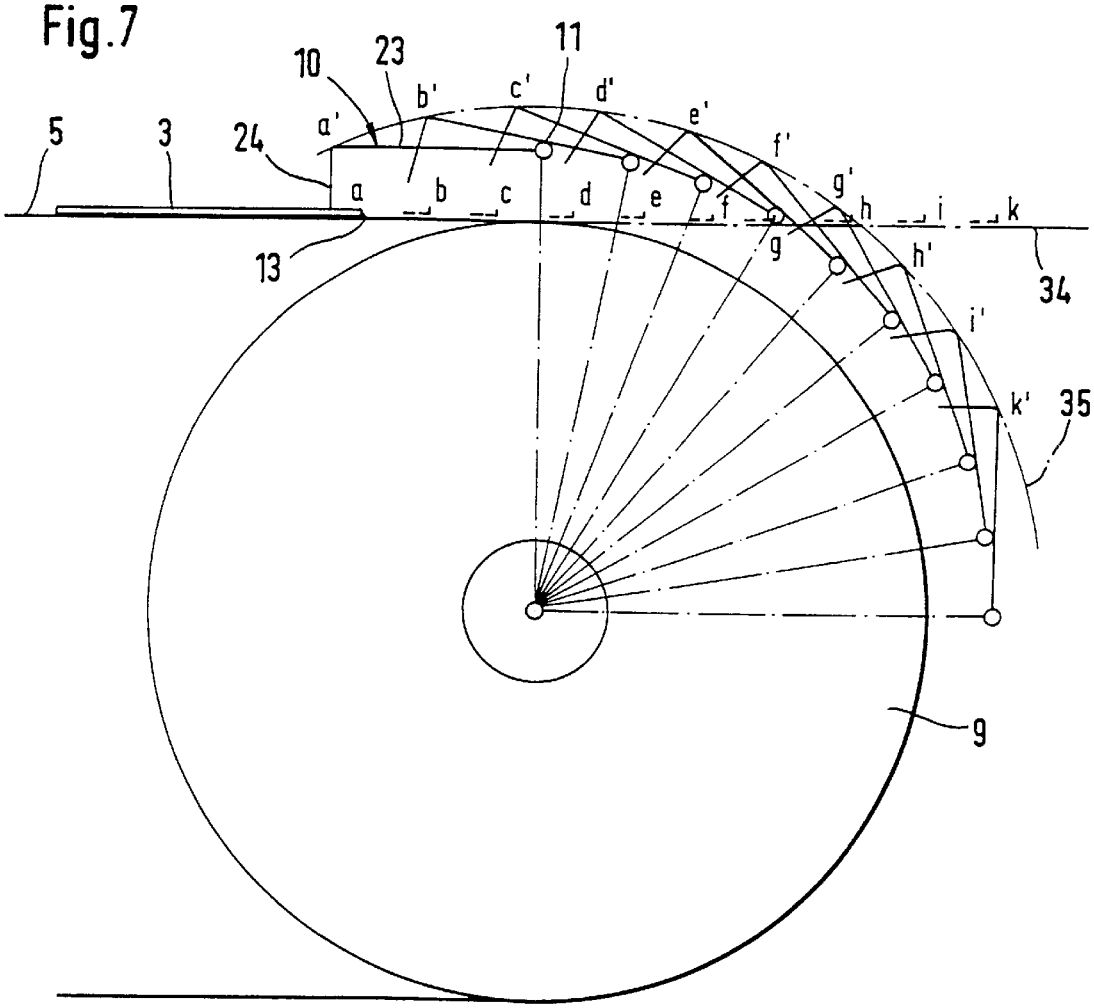
FIG. 7 is a schematically shown time sequence of the opening of the gripper in transport direction at the deflecting wheel.

With the aid of FIG. 7, the opening of the grippers 10 in the area of the deflecting wheel 9 is explained. As can be seen, the blank 3 has just arrived at the deflecting wheel 9, and its front edge 13 is held by means of a gripper 10, whose finger 23 presses with its free limb 24 the front area of the blank 3 to the transport belt 5.

While the transport belt 5 follows the periphery of the deflecting wheel 9, the blank 3, after leaving the deflecting wheel 9, has to follow the dot-dash line symbolizing the imaginary extension 34 of the transport belt 5, without being hindered by the gripper 10.

FIG. 7 shows, for example, ten sequential phases a to k of the momentary positions of the front edge 13 of the blank 3. A part of these phases a to k are the respective momentary positions a' to k' of the connecting bend of both of the limbs of the L-shaped finger 23. These momentary positions a' to k' define an enveloping curve 35, which must be submerged below the imaginary extension 34, before the front edge 13 of the blank 3 arrives there. As can be seen, the critical area is located between the phases g and h or between the positions g' and h'.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for transporting flat cardboard blanks for book cover or letter file machines, comprising:

at least two sequenced transport belts extending parallel to one another which are guided over a first deflecting wheel and a second deflecting wheel, grippers being applied to each of at least two of said belts for holding the blanks, wherein the grippers comprise controlled, swivelling clamping elements which can be opened at the first deflecting wheel as well as the second deflecting wheel, the gripper being configured so that the cardboard blanks follow an imaginary extension of the transport belts while the transport belts follow the periphery of the second deflecting wheel.

2. An arrangement according to claim 1, wherein the transport belts are toothed belts.

3. An arrangement according to claim 1, wherein the transport belts are toothed belts, and wherein the grippers are clamped in teeth gaps of the transport belts by affixing elements.

4. An arrangement according to claim 1, wherein the respective grippers comprise a supporting body on which the respective clamping element is supported with a swivel axle.

5. An arrangement according to claim 1, wherein the clamping elements are in the form of essentially L-shaped fingers whose free limbs can be advanced in their axial direction relative to the blank.

6. An arrangement according to claim 1, wherein the clamping elements are arranged in a transport direction A at a front edge of the blanks during transport of the blanks.

7. An arrangement according to claim 1, wherein at a distance corresponding to a defined spacing of two grippers in a transport direction of the transport belts, the deflecting wheels, in the form of toothed belt wheels each have a milled tooth for accommodating attaching of a gripper by an affixing element.

8. An arrangement according to claim 1, wherein cam discs are provided for controlling the clamping elements, said cam discs being arranged coaxially to the deflecting wheels in a stationary way, on which cam discs spring-loaded rollers are disposed which can swivel with the clamping elements.

9. An arrangement according to claim 1, wherein in an area of the deflecting wheels, for the purpose of bridging an opening phase of the clamping elements, clamping rollers are provided which guide the blanks.

10. An arrangement for transporting cardboard blanks in the flat for book cover or letter file machines, comprising at least three sequenced transport belts extending parallel to one another which are guided over deflecting wheels, two transport belts of which being outer belts and one transport belt of which being a center belt, wherein grippers for holding the blanks are only applied at the outer belts while the center belt is free of grippers.

11. An arrangement according to claim 10, wherein the transport belts are toothed belts, and wherein the grippers are clamped in teeth gaps of the transport belts by affixing elements.

12. An arrangement according to claim 10, wherein the respective grippers comprise a supporting body on which the respective clamping element is supported with a swivel axle.

13. An arrangement according to claim 10, wherein the grippers are in the form of essentially L-shaped fingers whose free limbs can be advanced in their axial direction relative to the blank.

14. An arrangement according to claim 10, wherein the grippers are arranged in a transport direction A at a front edge of the blanks during transport of the blanks.

15. An arrangement according to claim 10, wherein at a distance corresponding to a defined spacing of two grippers in a transport direction of the transport belts, the deflecting wheels, in the form of toothed belt wheels each have a milled tooth for accommodating attaching of a gripper by an affixing element.

16. An arrangement according to claim 10, wherein cam discs are provided for controlling the grippers, said cam discs being arranged coaxially to the deflecting wheels in a stationary way, on which cam discs spring-loaded rollers are disposed which can swivel.

17. An arrangement according to claim 10, wherein in an area of the deflecting wheels, for the purpose of bridging an opening phase of the grippers, clamping rollers are provided which guide the blanks.

18. An arrangement for transporting flat cardboard blanks while maintaining them in a plane between two positions in a cardboard blank processing machine, comprising:

a plurality of endless transport belts extending parallel to one another along a blank carrying section of their travel path, first and second deflection guide wheels supporting the transport belts at respective opposite ends of the blank carrying section of their travel path, blank grippers connected with each of two of the belts and operable to clamp cardboard blank to the belts, and gripper actuation devices at each of said guide wheels for moving the blank grippers between closed and open positions to facilitate gripping of the cardboard blank at the first guide wheel and releasing of the cardboard blank at the second guide wheel while maintaining the cardboard blank in a common plane during travel along the blank carrying section of the travel path of the belts and during continued movement of the cardboard blank away from the belts.

19. An arrangement according to claim 18, wherein the transport belts are toothed belts, and wherein the grippers are clamped in teeth gaps of the transport belts by affixing elements.

20. An arrangement according to claim 18, wherein the respective grippers comprise a supporting body on which the respective clamping element is supported with a swivel axle.

21. An arrangement according to claim 18, wherein the grippers comprise clamping elements which are in the form of essentially L-shaped fingers whose free limbs can be advanced in their axial direction relative to the blank.

22. An arrangement according to claim 18, wherein the grippers comprise clamping elements which are arranged in a transport direction A at a front edge of the blanks during transport of the blanks.

23. An arrangement according to claim 18, wherein at a distance corresponding to a defined spacing of two grippers in a transport direction of the transport belts, deflecting wheels, in the form of toothed belt wheels each have a milled tooth for accommodating attaching of a gripper by an affixing element.

24. An arrangement according to claim 18, wherein cam discs are provided for controlling the grippers, said cam discs being arranged coaxially to the deflecting wheels in a stationary way, on which cam discs spring-loaded rollers are disposed which can swivel with the grippers.

25. An arrangement according to claim 18, wherein in an area of the deflecting wheels, for the purpose of bridging an opening phase of the grippers, clamping rollers are provided which guide the blanks.

* * * * *